US009649683B2

(12) United States Patent
Opper et al.

(10) Patent No.: US 9,649,683 B2
(45) **Date of Patent: *May 16, 2017**

(54) JOINING MEANS

(71) Applicant: Newfrey LLC, Newark, DE (US)

(72) Inventors: Reinhold Opper, Buseck (DE); Ruben Gutierrez Romero, Wetzlar (DE)

(73) Assignee: NEWFREY LLC, New Britain, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/695,651

(22) Filed: Apr. 24, 2015

(65) Prior Publication Data

US 2015/0224564 A1 Aug. 13, 2015

Related U.S. Application Data

(60) Continuation of application No. 14/021,926, filed on Sep. 9, 2013, now Pat. No. 9,050,648, which is a (Continued)

(30) Foreign Application Priority Data

Feb. 5, 2004 (DE) ..... 10 2004 005 8849

(51) Int. Cl.
*B21J 15/30* (2006.01)
*B21J 13/03* (2006.01)
(Continued)

(52) U.S. Cl.
CPC ..... *B21J 15/30* (2013.01); *B21J 13/03* (2013.01); *B21J 15/025* (2013.01); *B21J 15/10* (2013.01);
(Continued)

(58) Field of Classification Search
CPC B21J 13/03; Y10T 29/53991; Y10T 29/5343; Y10T 29/53065; Y10T 29/49897;
(Continued)

(56) References Cited

U.S. PATENT DOCUMENTS 660,705 A * 10/1900 Kimman ..... B21J 7/34 173/114
937,150 A * 10/1909 Havener ..... A43D 100/02 221/176
(Continued)

FOREIGN PATENT DOCUMENTS

DE 197 43 277 A1 5/1999
FR 993420 A 10/1951
(Continued)

OTHER PUBLICATIONS

Tool Engineers Handbook, American Society of Tool Engineers, First Edition, 1949, pp. 1494-1578.
(Continued)

*Primary Examiner* — Christopher M Koehler
(74) *Attorney, Agent, or Firm* — Michael P. Leary

(57) ABSTRACT

In the invention, a joining means having a ram tool, a countertool and a holder with an opening to accommodate the ram tool or the countertool, is described. The two tools are arranged coaxial with each other at different ends of a C-bracket. The holder comprises at least one plane contact surface arranged on the outer surface of the holder, resting in contact with at least one plane face of the corresponding end of the C-bracket and detachably fastened thereto. Between the contact surface and the face, at least one interlay is arranged, determining the information and/or the distance of the contact surface from the face.

12 Claims, 10 Drawing Sheets

Related U.S. Application Data division of application No. 13/408,593, filed on Feb. 29, 2012, now Pat. No. 8,555,490, which is a division of application No. 11/499,387, filed on Aug. 4, 2006, now Pat. No. 8,151,454, which is a continuation of application No. PCT/EP2005/001002, filed on Feb. 2, 2005.

(51) Int. Cl.
*B21J 15/02* (2006.01)
*B21J 15/10* (2006.01)
*B21J 15/36* (2006.01)

(52) U.S. Cl.
CPC ..... *B21J 15/105* (2013.01); *B21J 15/36* (2013.01); *Y10T 29/49897* (2015.01); *Y10T 29/49943* (2015.01); *Y10T 29/5343* (2015.01); *Y10T 29/53065* (2015.01); *Y10T 29/5377* (2015.01); *Y10T 29/5397* (2015.01); *Y10T 29/53704* (2015.01); *Y10T 29/53991* (2015.01); *Y10T 83/8746* (2015.04)

(58) Field of Classification Search
CPC ..... Y10T 29/5377; Y10T 29/53704; Y10T 29/5397; Y10T 29/49943
USPC ..... 29/798, 246.53, 243, 465, 466.4, 470, 29/525.06, 432; 72/466.4, 470; 83/559–562
See application file for complete search history.

(56) References Cited

U.S. PATENT DOCUMENTS

| | | | | |
|---|---|---|---|---|
| 1,404,126 | A | 1/1922 | Krause | |
| 3,127,044 | A * | 3/1964 | Brown | B21J 15/10 29/283 |
| 3,405,436 | A | 10/1968 | Koett | |
| 4,756,072 | A * | 7/1988 | Falzoni | A41H 37/02 29/26 A |
| 5,463,807 | A * | 11/1995 | Hochhausl | A41H 37/00 227/15 |
| 5,752,305 | A | 5/1998 | Cotterill et al. | |
| 5,782,130 | A | 7/1998 | Sawdon | |
| 6,276,050 | B1 * | 8/2001 | Mauer | B21J 15/025 29/243.53 |
| 6,398,096 | B1 | 6/2002 | Lang | |
| 6,502,008 | B2 | 12/2002 | Maurer et al. | |
| 6,543,115 | B1 | 4/2003 | Mauer et al. | |
| 6,568,236 | B2 | 5/2003 | Kondo et al. | |
| 6,676,000 | B2 | 1/2004 | Lang et al. | |
| 6,725,521 | B1 | 4/2004 | Blacket et al. | |
| 6,742,235 | B2 | 6/2004 | Blacket et al. | |
| 6,789,309 | B2 | 9/2004 | Kondo | |
| 6,857,175 | B2 | 2/2005 | Blocher et al. | |
| 6,910,263 | B2 | 6/2005 | Naito | |
| 6,942,134 | B2 | 9/2005 | Naito | |
| 6,961,984 | B2 | 11/2005 | Naito et al. | |
| 6,964,094 | B2 | 11/2005 | Kondo | |
| 6,968,939 | B1 | 11/2005 | Mauer et al. | |
| 7,024,270 | B2 | 4/2006 | Mauer et al. | |
| 7,040,006 | B2 | 5/2006 | Mauer et al. | |
| 7,043,826 | B2 | 5/2006 | Naito | |
| 7,752,739 | B2 | 7/2010 | Mauer et al. | |
| 8,151,454 | B2 | 4/2012 | Opper et al. | |
| 2003/0051332 | A1 | 3/2003 | Meichsner et al. | |
| 2005/0019137 | A1 | 1/2005 | Iwatsuki et al. | |
| 2007/0034662 | A1 | 2/2007 | Opper et al. | |

FOREIGN PATENT DOCUMENTS

| | | |
|---|---|---|
| JP | 59-81600 | 6/1984 |
| JP | 61-72323 | 5/1986 |
| JP | 5-50162 | 3/1993 |

OTHER PUBLICATIONS

Opposition to corresponding European Patent No. EP 1711288 (Newfrey LLC) by Henrob Limited, with Exhibits/References D1-D6, dated Jan. 9, 2015.

Opposition to corresponding European Patent No. EP 1711288 (Newfrey LLC) by Eckold GmbH & Co. KG, with Exhibits/References A1-A3, dated Jan. 9, 2015 (with English machine translation).

* cited by examiner

JOINING MEANS

CROSS-REFERENCE TO RELATED APPLICATIONS

This application is a continuation of U.S. patent application Ser. No. 14/021,926 (presently allowed), filed on Sep. 9, 2013, which is a divisional of U.S. patent application Ser. No. 13/408,593, filed on Feb. 29, 2012 (issued as U.S. Pat. No. 8,555,490 on Oct. 15, 2013), which is a divisional of U.S. patent application Ser. No. 11/499,387, filed on Aug. 4, 2006 (issued as U.S. Pat. No. 8,151,454 on Apr. 10, 2012), which is a continuation of PCT Patent Application Serial No. PCT/EP2005/001002, filed on Feb. 2, 2005, which claims priority to German Patent Application Serial No. DE 10 2004 005 884.9, filed on Feb. 5, 2004. The entire disclosures of each of the above applications are incorporated herein by reference.

BACKGROUND AND SUMMARY

The invention relates to a joining means having a ram tool and a countertool, and a holder having an opening to accommodate the ram tool or the countertool. The two tools are oriented coaxial with each other at different ends of a C-bracket.

Such joining means are known and serve in particular to produce connections, for example rivet and self-piercing rivet connections. Known joining means comprise a ram provided with a drive and, as countertool, a matching die, arranged coaxial with each other, exacting requirements being imposed on the coaxiality of ram and die, since the strength and appearance of the connection produced depend on this to a very large extent. The coaxiality must be ensured for the long term and with the joining means in motion, since a large number of connections per unit time are produced by these means with the aid of robots. The so-called C-frame or C-bracket here serves as suspension and abutment in the motion of the tool, the C-bracket in the first place exhibiting low mass, and in the second place intended to assume the forces that occur in the process of connection. Similar problems arise in pressing, embossing machines and punches, i.e. wherever two cooperating tools (ram and die or anvil) must be oriented coaxially with each other.

The printed source DE 197 43 277 A1 describes a joining means of the kind mentioned in which, in a receiving bore in the upper web of a C-bracket, two eccentric sleeves are arranged for suspension of a rivet-setting tool. The eccentric sleeves comprise like eccentricity and are rotated relative to each other with a hook wrench to adjust the coaxiality or equalize faults of alignment. The rotary position can be fixed by means of a screw insertable in recesses on the periphery of the eccentric sleeve. The article "Stanznieten ist zukunftsträchtig in der Blechverarbeitung" [Self-piercing riveting has a future in the working of sheet metal] in the periodical *Bänder, Bleche, Rohre* (No. 5 of [19]91), pages 94 ff., describes a known self-piercing rivet system in which the ram tool is bolted to the upper end of a C-bracket.

The object of the invention is to create a joining means whose coaxial setting of ram tool and countertool is simply and economically attainable. Here it must be ensured that the coaxiality is maintained in the long term and with the joining means in motion. This object is accomplished according to the invention by the joining means having the features according to claim 1.

Apart from those advantages of the invention which correspond to the objective of achieving an economical, simple and enduring coaxiality of ram tool and countertool, it is made possible in addition by the joining means according to the invention to realize with a C-bracket the various tool distances and the use of various tools in various materials as well as the use of tool holders with different diameter of the receiving bore. Besides, the tools, in case of wear or further development, can be more simply, more quickly and more economically retrofitted or adapted to new problems. This is especially advantageous because C-brackets are very costly. They are made in one piece with the holder as a rule, because of the exacting requirements on rigidity. By separate fabrication from two or more parts, the production of the complete C-bracket can be rendered less expensive, and the C-bracket production time is shortened.

The objects described in the dependent claims represent advantageous refinements of the subject of claim 1. It is advantageous in particular to make the interlayer wedge-shaped, since the axial position of the ram or countertool can be influenced in a particular direction. It is likewise of advantage to provide several contact surfaces at right angles to each other or formed by the inner surfaces of a U-shaped element, so that the tool is more stably configured in motion. A highly advantageous manifold serviceability of the holder with respect to the distance from the countertool is made possible if the holder and the corresponding end of the C-bracket are of such configuration that the holder is rotatable through 180°. Other advantages of the preferred embodiments will be found in the following description.

BRIEF DESCRIPTION OF THE DRAWINGS

The invention will now be illustrated in more detail in terms of embodiments represented in the drawing by way of example. In the drawing.

DETAILED DESCRIPTION

Figure 1:
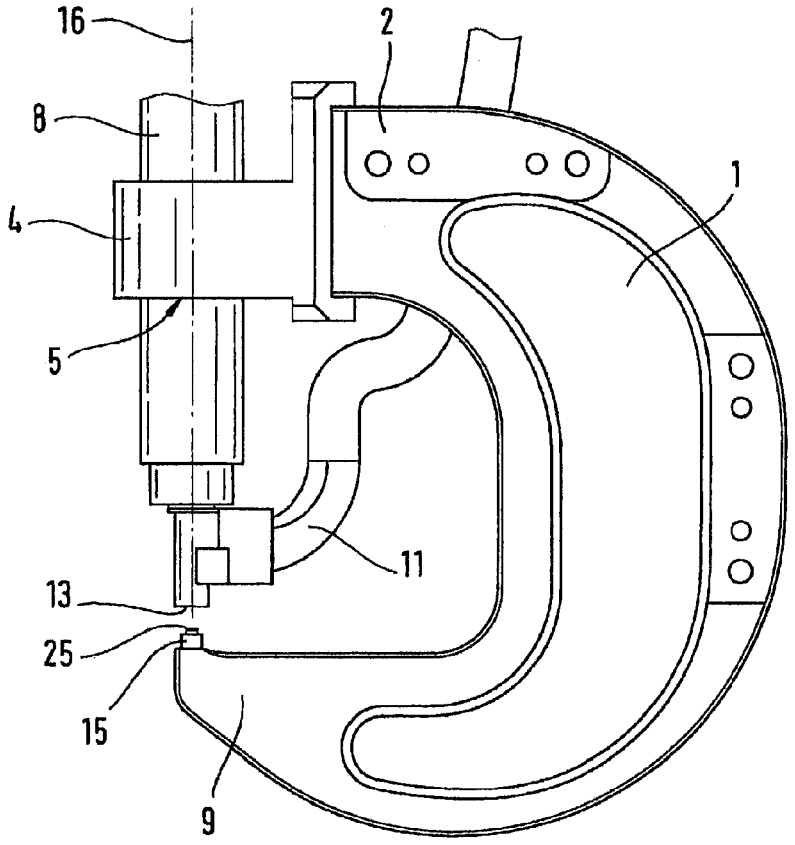
FIG. 1 shows parts of a joining means according to the invention in a view from the side.

FIG. 1 shows parts of a joining means, in this case a self-piercing rivet means. On the C-bracket 1, at one end, in this case the upper end 2 of the C-bracket 1, a holder 4 is arranged in whose preferably cylindrical through opening or bore 5 a ram tool 8 is arranged, in this case a self-piercing rivet tool. Here FIG. 1 does not show that the ram tool 8 at its end away from the C-bracket 1 comprises a number of other means for moving the ram tool 8 and to supply energy. At the end of the ram tool 8 facing the other, in this case the lower end 9 of the C-bracket 1, there is a feed means 11 holding small parts, in this case self-piercing rivets, in readiness as required for the connection. The outermost end of the ram tool, facing the bottom end 9 of the C-bracket 1, comprises a ram 13. At the other bottom end 9 of the C-bracket 1, a die carrier 15 with a die or an anvil 25 is arranged. To produce a connection, for example, a self-piercing rivet arranged on the ram 13 is forced in into two metal sheets arranged between ram 13 and die 25 by a motion of the ram 13 in the direction of the die 25 along the axis 16, so that the ends of the self-piercing rivet cut into the metal sheet and produce a connection of the sheets, together with a corresponding deformation thereof. By the cooperation between ram 13 and die 25 required for this and similar operations, these must be exactly oriented coaxially, this coaxiality being influenced by the attachment of the holder 4 to the upper end 2 of the C-bracket 1.

In another embodiment, by way of example, the feeding means 11 may also be guided by a bore in the holder 4 (not shown). Such a bore extends essentially parallel to the holder opening 5 and may for example be arranged behind the holder opening 5 in the direction of the front end 2 of the C-bracket 1. The bore for the feed means may for example comprise a round or a rectangular cross-section.

Figure 2:
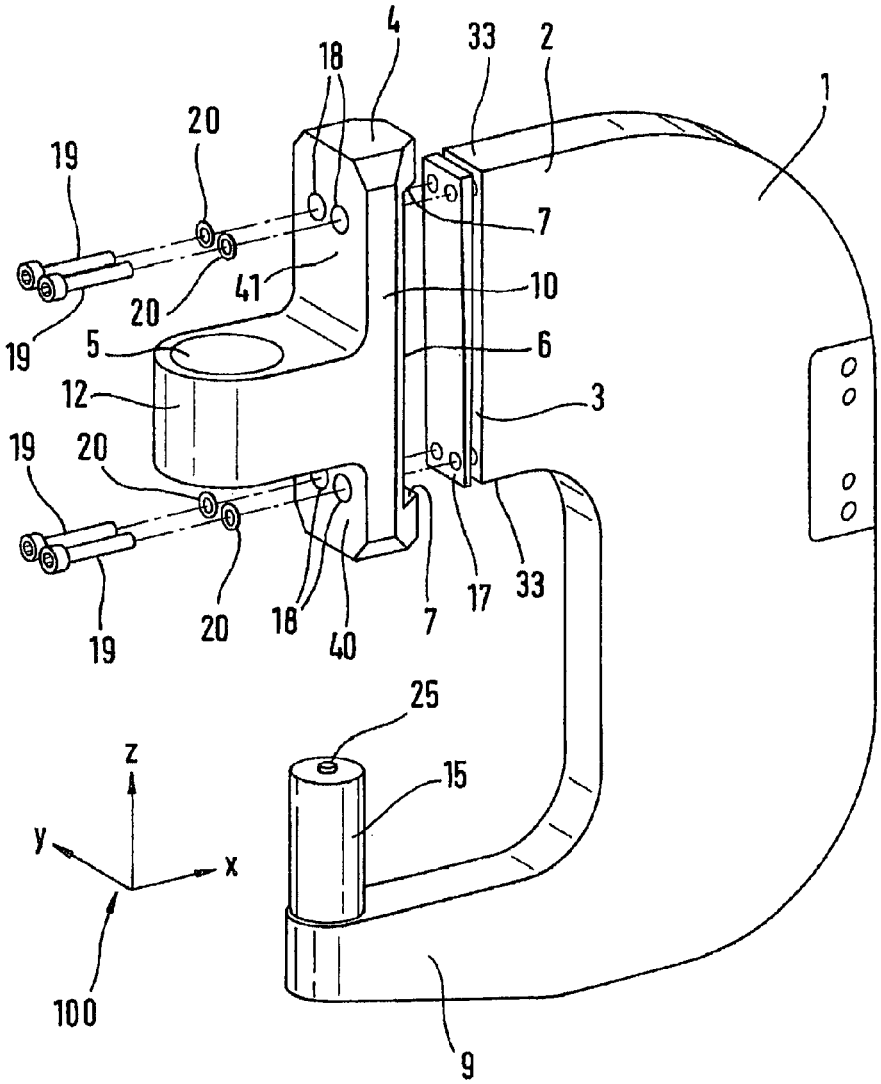
FIG. 2 shows the C-bracket, holder and countertool of a joining means according to the invention in exploded representation.

FIG. 2 shows the C-bracket 1, the holder 4, the die carrier 15 with die 25, and all other pertinent parts once again in an exploded perspective representation. At the upper end 2 of the C-bracket 1, opposed to the front plane face 3 of the C-bracket, the plane contact surface 6 of the holder 4 is arranged. The face 3 and the contact surface 6 here extend parallel to the middle part of the C-bracket 1 or parallel to the axis of the holder opening 5. The holder 4 is provided with a U-shaped recess formed by the contact surface 6 and the contact surfaces 7 perpendicular thereto. The contact surfaces 7 are arranged opposed to the top and bottom faces 33 of the C-bracket 1. The contact surfaces 7 and faces 33 here extend more or less perpendicular to the middle part of the C-bracket 1, or perpendicular to the axis of the holder opening 5.

In the following, all surfaces of the C-bracket located at the anterior end of the upper end 2 of the C-bracket 1 opposed to the contact surfaces of the holder will be referred to as faces. The holder 4 consists of a plate-like segment 10 and a receiving body 12 arranged on the plate-like segment 10 on the side opposed to the contact surface 6. The longest extent of the plate-like segment 10 runs parallel to the axis through the holder opening 5. On the side of the plate-like segment 10 opposed to the receiving body 12, the holder 4 comprises the U-shaped recess for the contact surfaces 6 and 7. The holder opening 5 is arranged in the receiving body 12. The receiving body is arranged off-center on the plate-like segment, so that in this embodiment by way of example the longer part 41 lies on the side of the receiving body 12 opposed to the die 25, and the shorter part 40 of the plate-like segment 10 lies below the receiving body.

For better illustration of descriptions of direction, laterally in FIG. 2 a Cartesian coordinate system 100 is arranged, showing the three mutually perpendicular space directions x, y and z. These directions are to be retained for the following figures. To orient the holder opening 5 and with it also the ram coaxial with the die 25, between the contact surface 6 and the face 3 an interlay 17 is inserted, here of wedge-shaped configuration by way of example. By the interlay 17, the lower end of the axis of the ram 13 is tilted slightly in x-direction, since the wedge thickens towards the upper end 10 of the C-bracket 1. After insertion of the fitted interlay 17 the holder 4 and the interlay 17 are releasably fastened to the face 3 by means of screws 19 and washers 20. For this purpose, the holder 4 comprises matching step bores 18 in the plate-like segment 10, the interlay 17 comprises through holes, and the C-bracket comprises three threaded holes in the face 3. Here the step bores 18 and the U-shaped recess for the contact surfaces 6 and 7 are arranged rotationally symmetrical in such manner that the holder 4, even after a rotation by 180° about the x-axis, which is perpendicular to the plate-like segment 10, can be attached to the upper end 2 of the C-bracket 1.

The interlay 17 may be configured to trim the holder 4 as a wedge or triangular prism whose thickening, in the embodiment represented by way of example in FIG. 2, points in the direction of the other end 9 of the C-bracket. In another embodiment by way of example, the interlay 17 may be alternatively configured as a plate in the shape of a rectangular prism, so that the axis of the bore 5 and hence the direction of motion of the ram 13 is displaced only in the direction away from the C-bracket 1, that is, in the direction of the x-axis. In general, the interlay 17 is very thin and configured with two parallel plane surfaces, so that the existing holes can be used to fasten the holder 4 to the C-bracket 1. The first plane surface is arranged neighboring upon the face 3 of the C-bracket 1, and the second plane surface faces the contact surface 6 of the holder 4. The two plane surfaces may be arranged parallel to each other (rectangular prism interlay) or enclose some arbitrary angle in any arbitrary direction of space, the angle being at most a few degrees. In an embodiment by way of example, the two planes preferably have a thickness from a few tenths of a millimeter to a few millimeters at their greatest thickness, in particular 2 mm to 4 mm. The interlay 17 may be arranged at the contact surface 6 of the holder 4 running parallel to the axis of the bore/opening 5. By the use of various interlays on the contact surface 6, the orientation of the axis of the holder bore 5 and with it the direction of motion of the ram tool can be so controlled that a displacement of the axis of the holder bore 5 in the direction of the x-axis and/or the y-axis and/or the z-axis and/or a tilting of the axis of the holder bore to the x-axis and/or the y-axis will take place.

Figure 3:
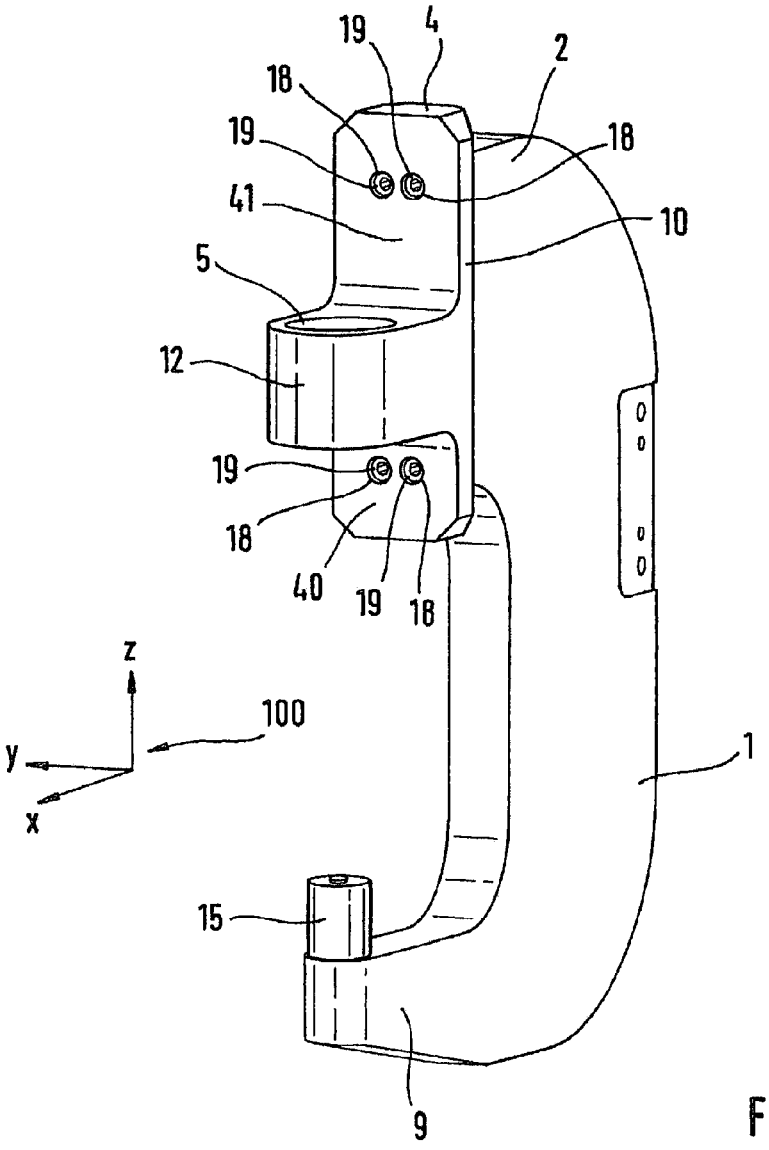
FIG. 3 shows C-bracket, holder and countertool in a perspective view obliquely from in front.

At the bottom end 9 of the C-bracket 1, the die carrier 15 is attached. The die 25 is arranged on the die carrier 15. It is also conceivable that, in particular with a motion of the die carrier, instead of the ram 13 the die carrier 15 comprises a holder similar to the holder 4 of the ram 13, capable of adjustment like the latter. In FIG. 3, the C-bracket 1 with holder 4 and die carrier 15 of FIG. 2 is again represented in a perspective view obliquely from the front.

In FIGS. 4*a* to 4*c*, various embodiments of the arrangement of the holder 4 in FIGS. 2 and 3 and for the die carrier 15 are represented. In FIG. 4*a*, the die carrier 15 has a height h1, so that in this arrangement there is a length L1 between the upper end of the die carrier 15 and the lower end of the receiving body 12 in the direction of the z-axis in which the ram tool can act. The bore 5 in this embodiment by way of example comprises a diameter d. For the solution of various connection problems, the holder 4, which is of detachable and replaceable conformation, can be combined with various diameters d of the bore 5, with different holder designs and different holder materials, as well as with different heights of the countertool.

FIG. 4*b*, by way of example, shows the die carrier 15 provided with a height h2 greater than h1. Further, the holder 4 is rotated 180° from the embodiment in FIG. 4*a* about the x-axis, which is perpendicular to the plate-like segment, so that the shorter part 40 of the plate-like segment 10 is now arranged above the receiving body 12. The longer part 41 of the plate-like segment 10 is accordingly arranged on the side of the receiving body 12 opposed to the lower end 9 of the C-bracket 1. Between the lower end of the receiving body 12 and the upper end of the die carrier 15, accordingly, a length L2 is configured in the direction of the z-axis, the die carrier 15 having a height h2 above the bottom end of the C-bracket 1. The embodiment pictured by way of example in FIG. 4*c* corresponds to the embodiment according to FIG. 4*b*, where the height h3 of the die carrier 15 above the bottom end 9 of the C-bracket 1 is smaller than the height h2 and greater than the height h1. Between the bottom end of the receiving body 12 and the top end of the die carrier 15, therefore, a length L3 is configured in the direction of the z-axis.

Figure 4:
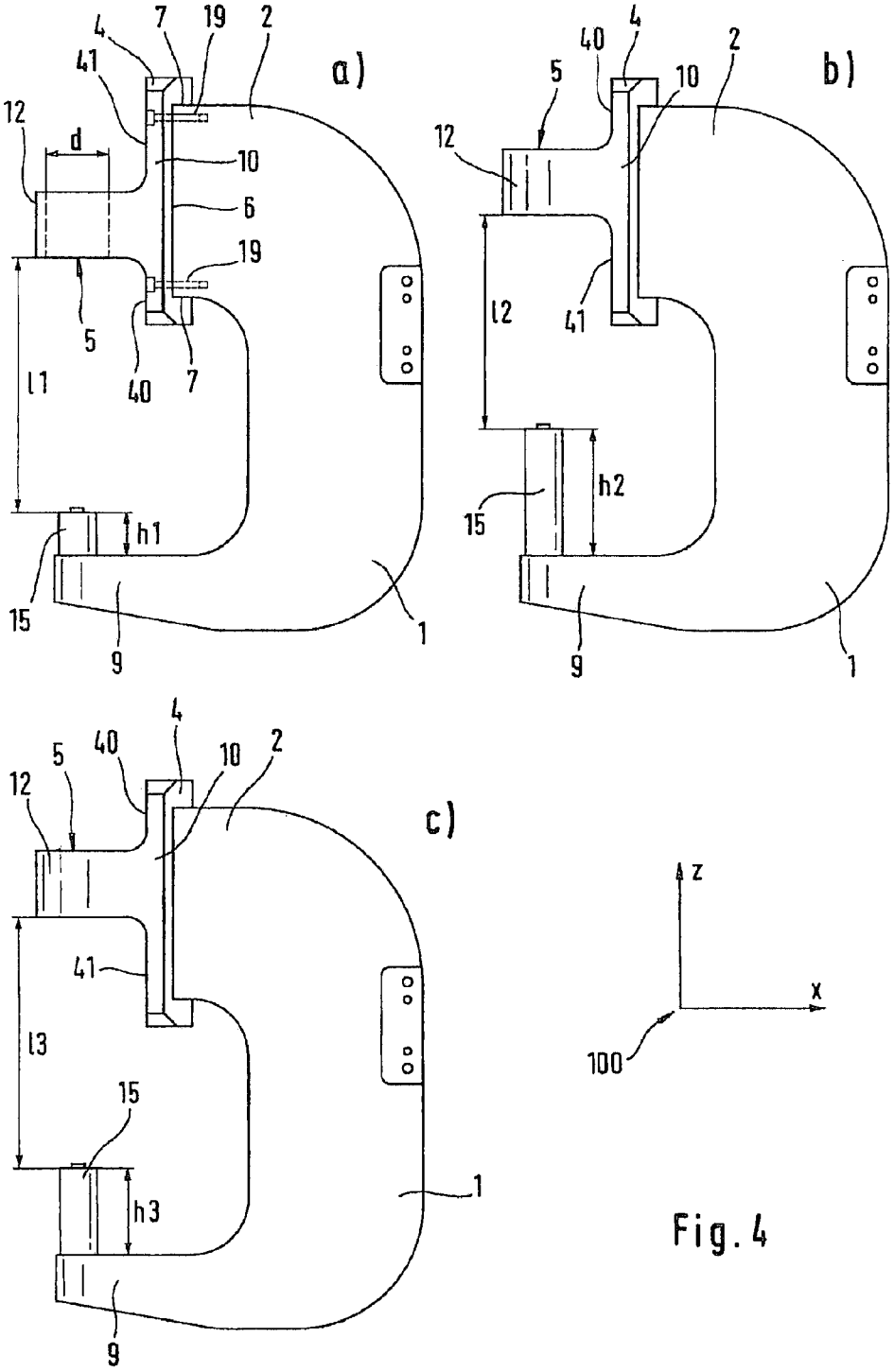
FIG. 4 shows various arrangements of holder and countertool on the C-bracket of a joining means according to the invention in side view.
Figure 5:
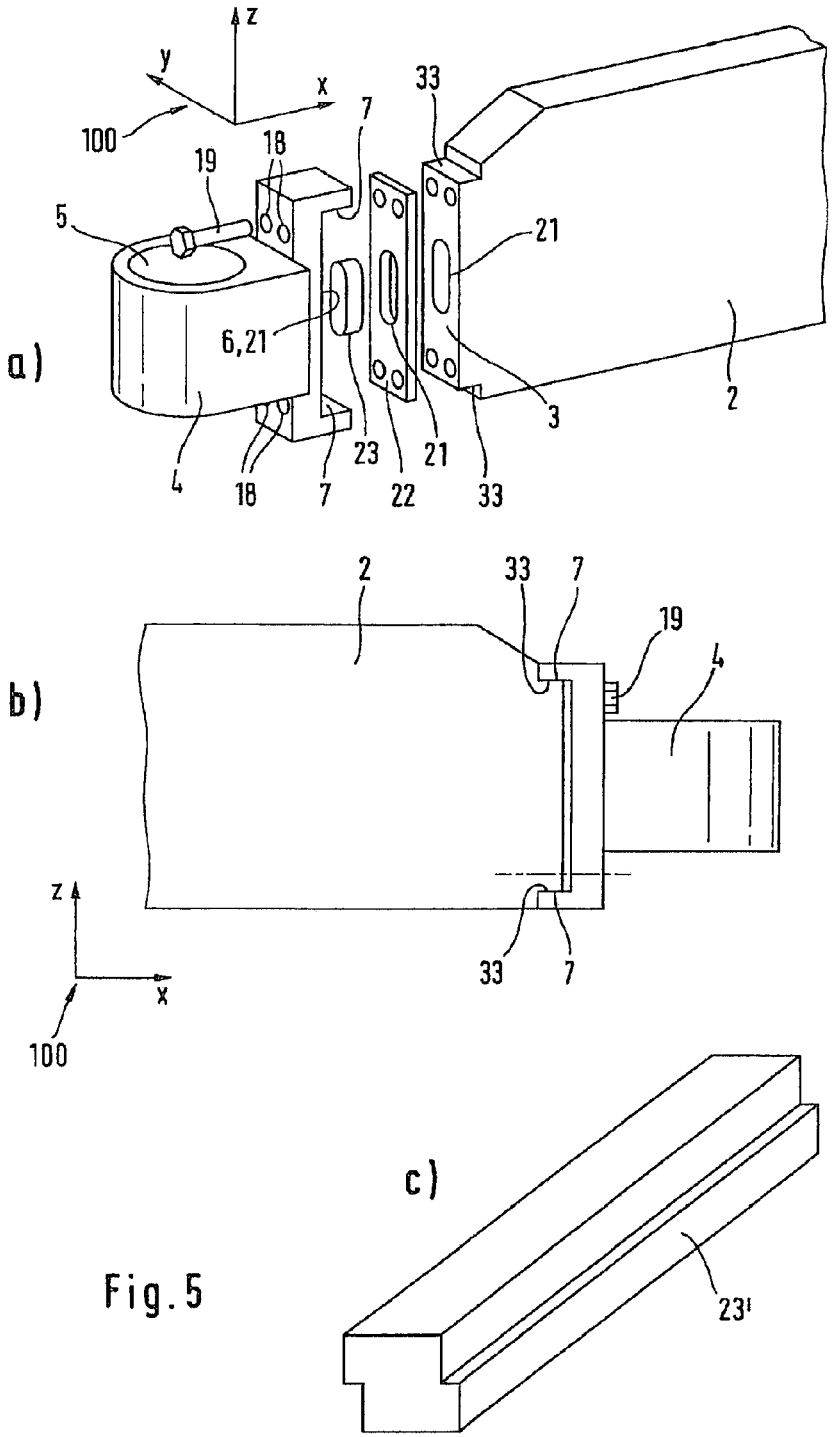
FIG. 5 shows another embodiment of holder and corresponding end of the C-bracket of a joining means according to the invention in an exploded perspective view (a) and a view from the side (b) as well as an embodiment by way of example of an adjusting spring in a perspective view from the side (c)

In FIG. 5*a*, in another embodiment of the invention by way of example, the holder 4 is arranged at the end 2 of the C-bracket, between whose contact surface 6 and the face 3 of the upper end 2 of the C-bracket, the interlay 22 is inserted. The holder 4, like the holder 4 in FIGS. 2, 3 and 4, comprises U-shaped contact surfaces 6, 7. The contact surfaces 7 arranged perpendicular to the axis of the bore 5 rest, in an installed condition, on the upper and lower faces 33, set off by a step from other areas of the one end 2 of the C-bracket. To prevent slip of the interlay 22 relative to the holder 4, the interlay 22 and (not shown) the contact surfaces 6 of the holder 4 as well as the front face 3 of the end 2 each comprise a recess 21 or a slit in which a fitting spring 23 is inserted. Here the recesses 21 in the interlay 22, in the contact surface 6 and in the face 3 of the holder 4 lie one above another. The holder 4 and the interlay 22, much as in the embodiment by way of example according to FIGS. 2, 3 and 4, are detachably fastened to the upper end 2 of the C-bracket by means of screws 19. The spring 23 pictured in FIG. 5*a* has a rectangular cross-section.

FIG. 5*c* shows another embodiment by way of example for a spring 23', provided with steps arranged along the lengthwise direction of the spring. This makes possible the equalization of an offset between the recesses 21 in the front face 3 and the contact surface 6, and possibly the interlay 22, in y-direction. In FIG. 5*b*, it may be seen that the contact surfaces 7 are arranged to back up the counterforce on the faces 33 separated by a step from the remaining part of the end 2 of the C-bracket.

Figure 6:
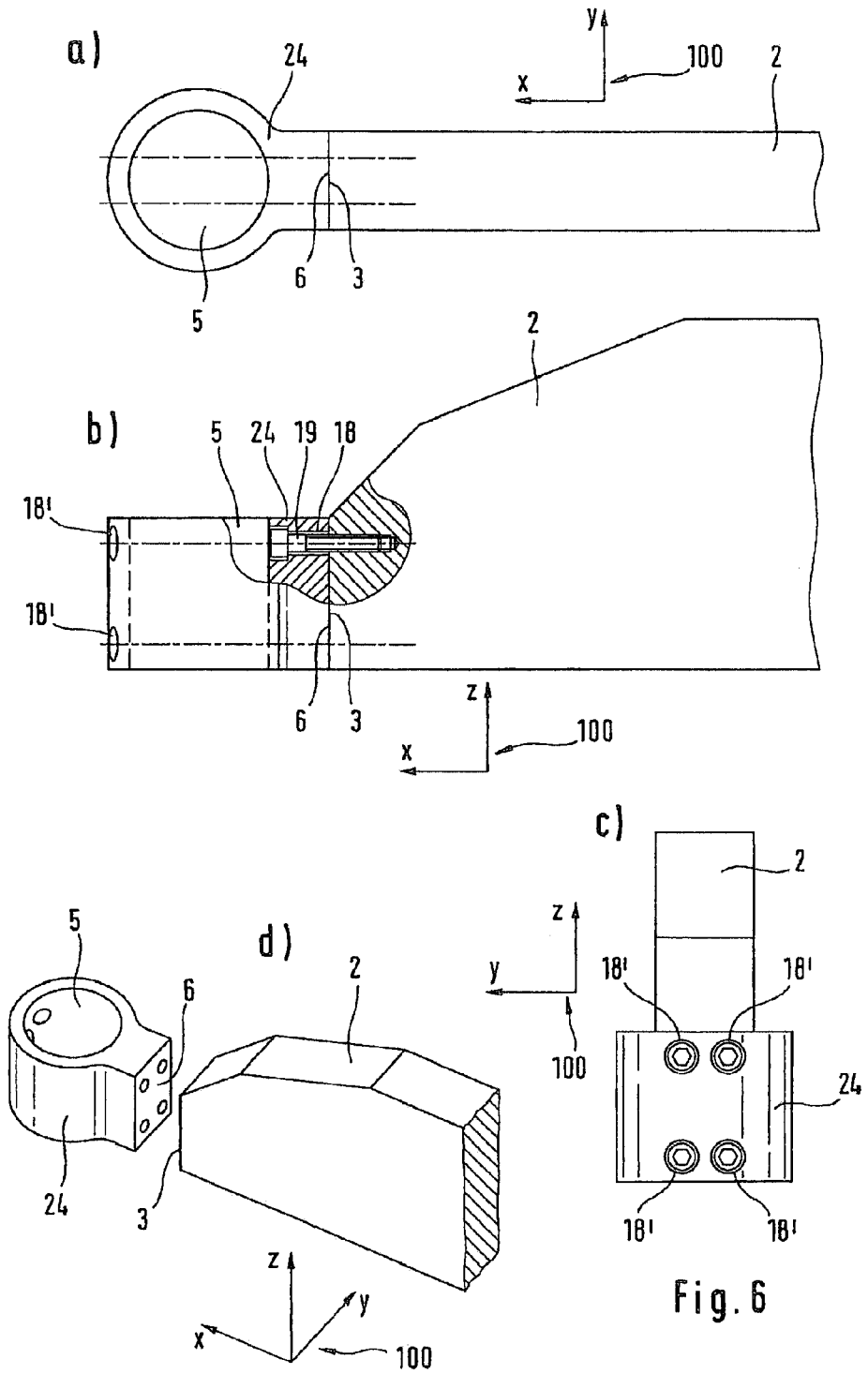
FIG. 6 shows another embodiment of holder and corresponding end of the C-bracket of a joining means according to the invention in a view from below (a), a view from the side (b), a view from the front (c), and a perspective view from the side (d)

FIG. 6 shows another embodiment of the invention by way of example, with a holder 24 and the one end 2 of the C-bracket. The holder 24, arranged at the face 3 of the upper end 2 of the C-bracket, has the shape of a cylinder with a handle-like projection. In the cylinder, the through hole 5 is arranged to accommodate the ram tool. At the end of the projection, the holder 24 comprises a contact surface 6 running parallel to the axis of the bore 5. Much as in the embodiments by way of example according to FIGS. 2 to 5, an interlay (not shown here) may be arranged between contact surface 6 and face 3.

The step bores 18 to accommodate the fastening elements (screws 19) are located on the handle-like area of the cylindrical holder part, configuring the contact area 6. In FIG. 6*b*, the area of an upper step bore 18 and the area of the corresponding threaded hole arranged in the face are shown cut out. The screw 19 is arranged countersunk in the step bore 18, and its thread engages the thread of the threaded hole in the face 3. To arrange the screw 19 in the step bore 18, bores 18' are provided in the side of the cylindrical segment of the holder 24 opposed to the step bore 18, serving for passing the screws 19 in towards the step bore 18.

Figure 7:
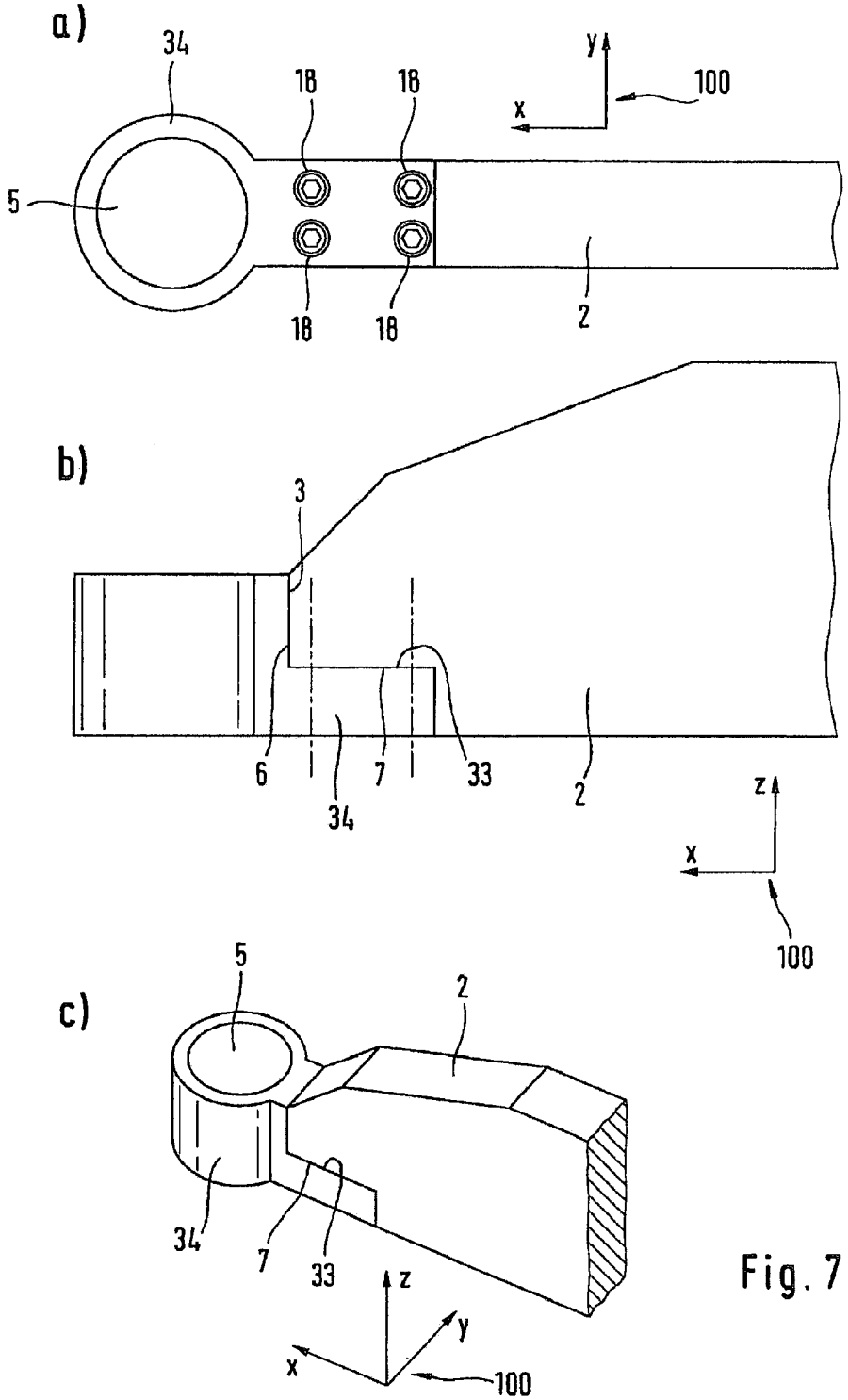
FIG. 7 shows another embodiment of holder and corresponding end of the C-bracket of a joining means according to the invention in a view from below (a), a view from the side (b) and a perspective view from the side (c)

With reference to FIGS. 7*a* to 7*c*, an additional embodiment is illustrated by way of example, of which the one end 2 of the C-bracket and the holder 34 are represented. The cylindrical portion of the holder with bore 5 comprises a continuation having a contact surface 6 parallel to the axis of the bore 5 and a contact surface 7 running perpendicular thereto. Correspondingly, the faces 3 and 33 of the upper end 2 of the C-bracket 1 are configured perpendicular to each other. In this embodiment by way of example, the bores 18 to receive the fastening elements are located on the side of the holder continuation located opposed to the contact surface 7. This may be clearly seen in FIG. 7*a*. Not shown in the drawing are the thin interlays arranged between contact surface 6 and face 3 and/or contact surface 7 and face 33 to adjust the holder 34 in the direction of the x-axis and/or of the y-axis and/or of the z-axis.

Figure 8:
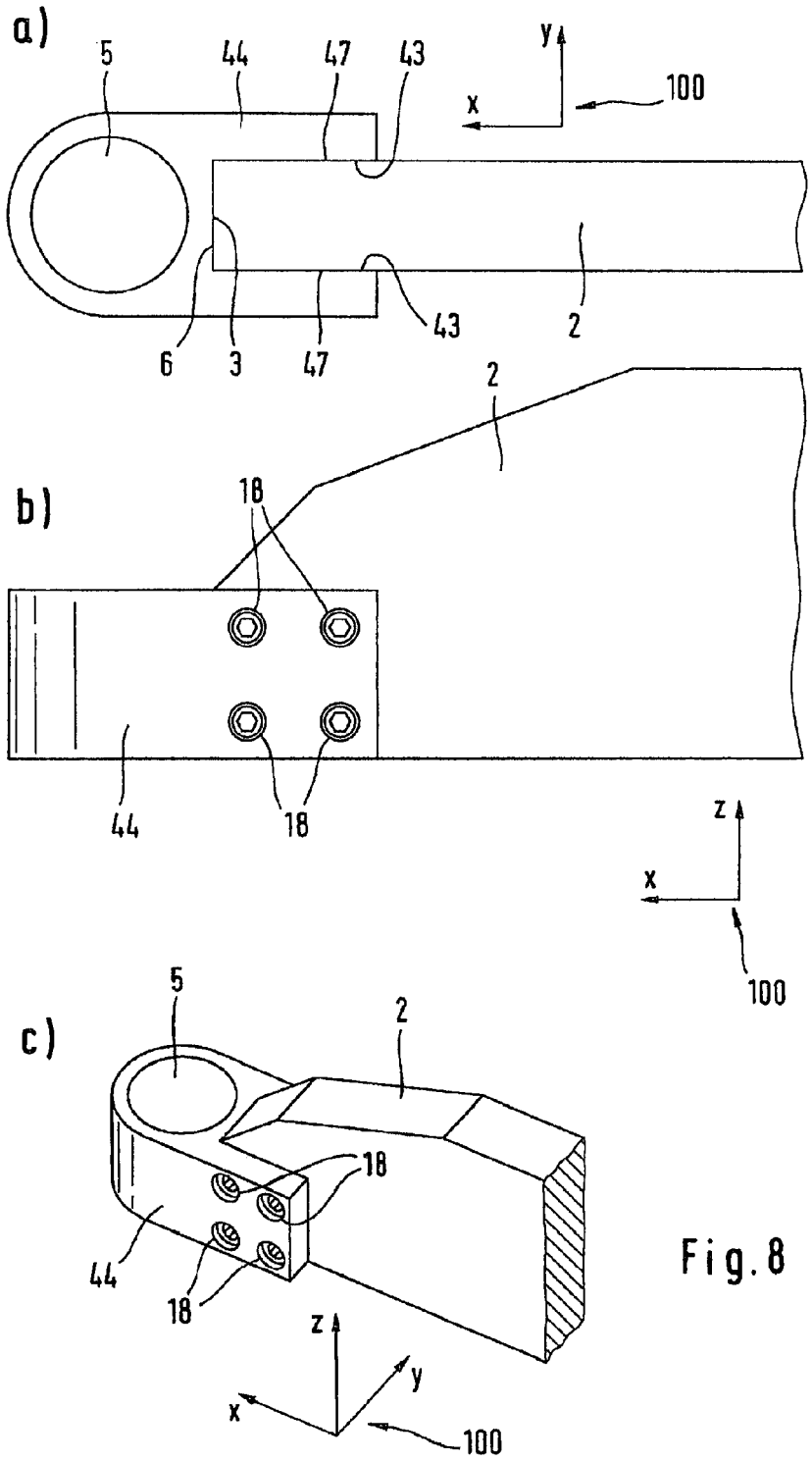
FIG. 8 shows another embodiment of holder and corresponding end of the C-bracket of a joining means according to the invention in a view from below (a), a view from the side (b) and a perspective view from the side (c)

FIG. 8 represents an additional embodiment of the invention by way of example. In this case the holder 44 is provided with contact surfaces 47 and 6 in U-shaped arrangement, all running parallel to the axis of the bore 5, the parallel contact surfaces 47 and the contact surface 6 being perpendicular to each other. The holder 44 includes the frontal end 2 of the C-bracket with the corresponding lateral faces 43 and rests in contact with the face 3 perpendicular to these against the contact surface 6. The bores 18 for detachable fastening of the holder 44 to the end 2 of the C-bracket are arranged in the legs of the holder 44 forming the contact surfaces 47 and the end 2 located between them.

Figure 9:
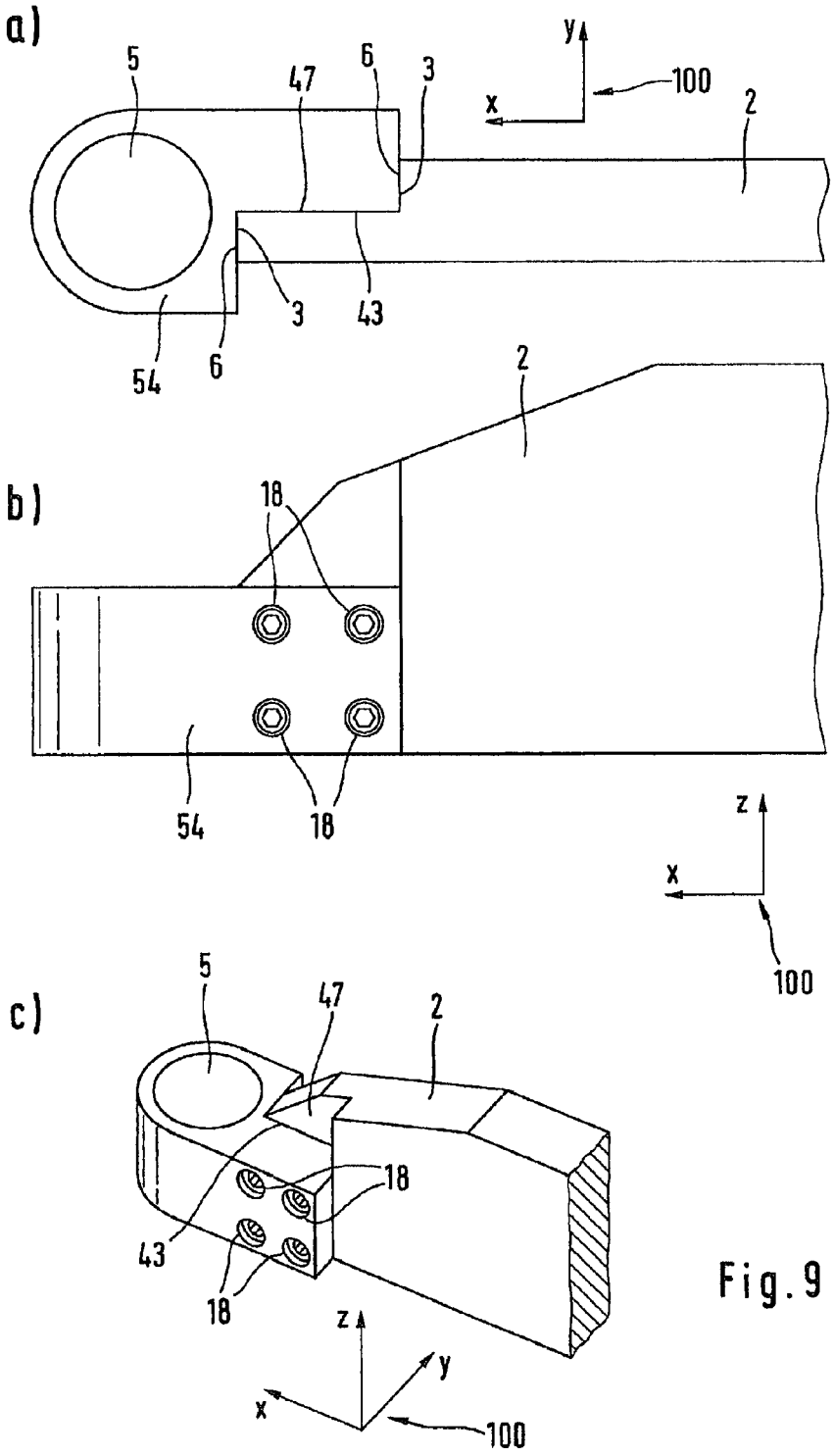
FIG. 9 shows another embodiment of holder and corresponding end of the C-bracket of a joining means according to the invention in a view from below (a), a view from the side (b) and a perspective view from the side (c)

FIG. 9 shows another embodiment of the invention by way of example, having a lateral contact surface 47 and two contact surfaces 6 arranged perpendicular thereto on the holder 54 and corresponding faces 3 on one end 2 of the C-bracket. The two contact surfaces 6 and the corresponding faces 3 lie offset in x-direction, and are separated from each other by a lateral contact surface 47 or a lateral face 43. Compared to FIG. 8, the lateral contact surface 47 and correspondingly the lateral face 43 are provided only once. In this case also, the attachment of the holder 54 takes place at the upper end of the C-bracket 1 by means of bores 18. The bores are provided in the continuation or shank of the holder 54, which forms the contact surface 47.

In the embodiments illustrated by way of example with reference to FIGS. 8 and 9, thin interlays (not shown) are arranged between contact surface 47 and lateral face 43 and/or contact surface 6 and face 3, which make possible a setting of the holder 44, 54 to adjust coaxiality. To relieve the screw connection of the embodiments according to FIG. 8 or 9, a groove spring connection may be provided.

Figure 10:
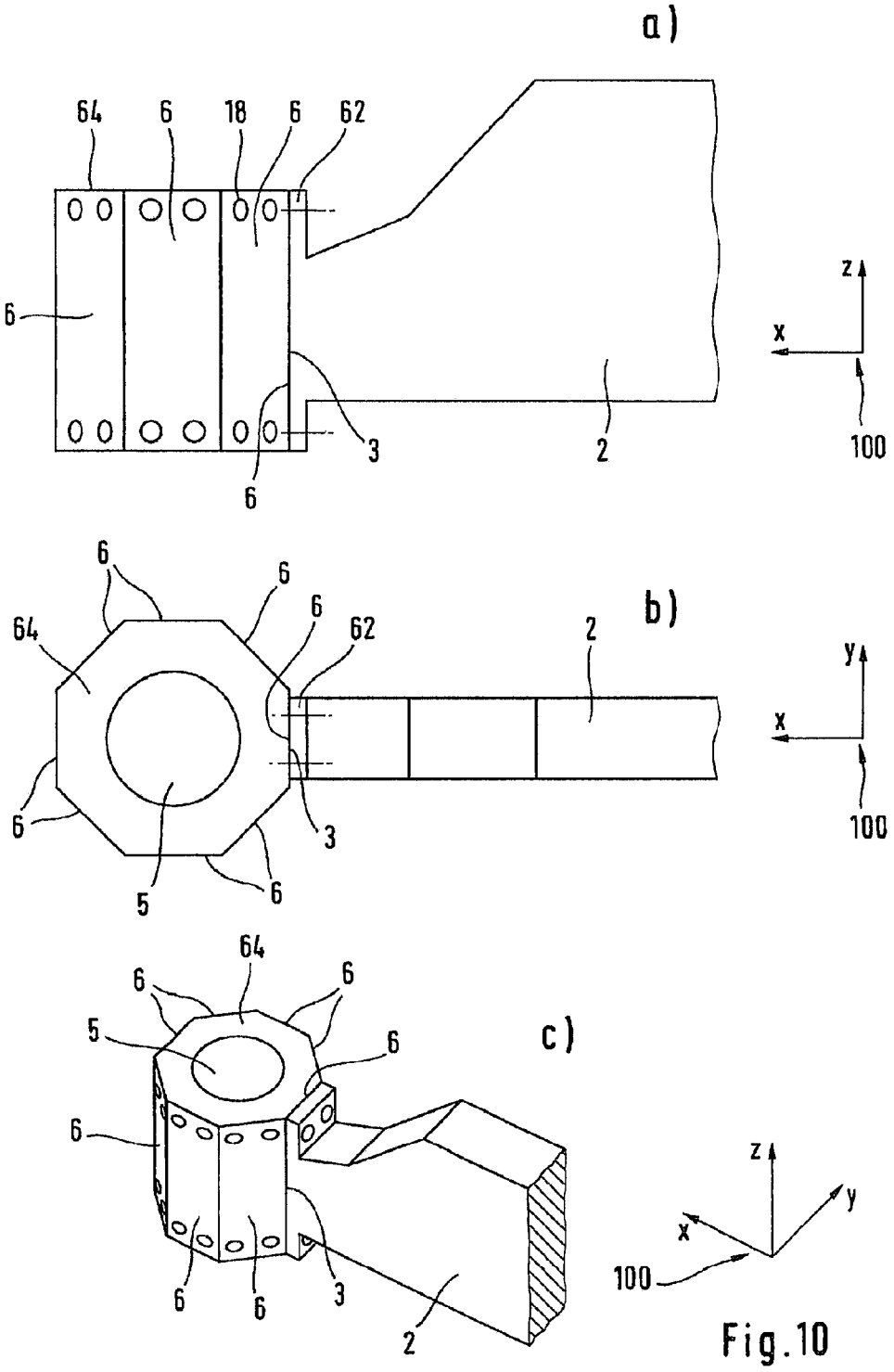
FIG. 10 shows another embodiment of holder and corresponding end of the C-bracket of a joining means according to the invention in a view from the side (a), a view from above (b) and a perspective view from the side (c).

Another embodiment of the invention by way of example may be seen in FIG. 10. The figures show the one end 2 of the C-bracket and the holder 64, arranged on the plane face 3 of the C-bracket. The face 3 of the C-bracket runs parallel to the axis of the motion of the ram or of the holder bore 5. The holder 64 is of prism conformation, with an octagonal base. The holder 64 comprises a through bore 5, serving to accommodate the ram tool. The bore 5 is of such configuration that it runs non-concentrically with the axis of the octagonal prism, and/or does not coincide with this axis. In another embodiment by way of example, the prism is not of circularly symmetrical configuration, so that no axis can be defined for the prism. The deviations, i.e. the angle between axis of prism and axis of bore, or the deviations from circular symmetry, are very small. Hence the bore comprises at least two different, preferably all plane, contact surfaces 6, which at the same time are side surfaces of the holder 64 and a different distance and/or a different inclination. All contact surfaces 6 form the envelope of the prism. The holder 64 may be arranged with each individual one of the contact surfaces 6 on the face 3 in accordance with the required inclination of the bore axis and/or in each instance the required distance of the bore axis from the face 3 in the direction of the x-axis and/or of the y-axis and/or of the z-axis, so that an especially simple adjustment of the holder and hence of the ram tool or the countertool is made possible.

In a preferred embodiment by way of example, the end 2 of the C-bracket at the frontal end comprises a plate-like segment 62, essentially in the shape of a rectangular prism and configured on the side of the face 3 facing the holder 64 for attachment of the holder. This face 3 is at the same time the largest surface of the rectangular prism, and serves for better attachment of the holder 64 to the face 3. The bores 18 for detachable fastening of the holder 64 are present on each contact surface 6, while in a preferred embodiment by way of example, similarly to the example according to FIG. 6, there may be through holes on the opposed side of the prism, through which the screws are inserted when fastening the holder 64 to the face 3. Here the bores 18 are provided symmetrical in such manner that upon a rotation of the prism through 180° around the x-axis, which is perpendicular to the axis of the bore 5, the prism can likewise be attached to the face 3.

As an alternative to the plane side surfaces of the holder 64, in another example (not shown) the side surfaces comprise notches, and the face 3 correspondingly comprises projections, where in attaching the holder to the end of the C-bracket the projections of the face engage the notches of a side surface. In another embodiment by way of example, the prism of the holder 64 may have other base areas, for example a triangle, square or hexagon. Another embodiment of the invention by way of example may consist in that one of the previously described holder at the same time forms the housing of the ram tool.

What is claimed is:

1. A joining apparatus for setting a rivet, the joining apparatus comprising:

a ram tool;

a counter tool, the ram and the counter tool being structured for setting the rivet;

a tool holder having at least one planar contact surface, the tool holder including an opening having an axis and receiving one of the ram tool and the counter tool; and a substantially C-shaped frame having a planar end face adjacent a first end, and the one of the ram tool and the counter tool not received in the opening being connected to the frame adjacent a second end;

an interlay located between the at least one planar contact surface of the tool holder and the planar end face of the frame, when the tool holder, interlay, and frame are releasably fastened together to define at least one of an inclination and a distance between the planar contact surface and the planar end face to position the ram tool and the counter tool coaxial with each other throughout an actuation of the ram tool during a rivet setting operation, and the interlay is installable in one of a first position and a second position, and in the interlay first position the axis of the tool holder opening is a first axis and in the second interlay position the axis of the tool holder opening is a second axis non-parallel to the first axis.

2. The apparatus of claim 1, further comprising removable fasteners extending through both the tool holder and the interlay to releasably secure the tool holder and the interlay to the frame.

3. The apparatus of claim 1, wherein the interlay is rotatable 180 degrees for installation in either the first position or the second position.

4. The apparatus of claim 3, wherein the interlay is wedge shaped having a first thickness at a first interlay axial end and a different second thickness at a second interlay axial end.

5. The apparatus of claim 4, wherein the interlay includes at least one hole proximate to both of the first and second interlay axial ends and aligned with one of a plurality of step bores partially defined in the tool holder both when the interlay is positioned between the tool holder and the frame in the first position and the second position rotated 180 degrees with respect to the first position.

6. The apparatus of claim 1, wherein the ram tool includes a movable ram, and the ram tool is received in the opening of the tool holder, and the ram of the ram tool is movable along the axis of the opening.

7. The apparatus of claim 1, wherein the counter tool includes a die, and the tool holder includes a mounting segment and a receiving body extending radially from a first side of the mounting segment, and the receiving body partially defines the opening as a substantially circular through opening, and the receiving body is located axially off-center with respect to the mounting segment creating a longer part and a shorter part, whereby selection of either the longer part or the shorter part of the mounting segment being closer to the die operates to change a length between the body and the die.

8. The apparatus of claim 1, wherein the ram tool is received in the opening of the tool holder and the counter tool is connected to the frame adjacent the second end of the C-shaped frame.

9. The apparatus of claim 1, wherein the tool holder further includes opposed second and third planar contact surfaces and the at least one planar contact surface of the tool holder is positioned between the opposed second and third planar contact surfaces oriented perpendicular to the one planar contact surface.

10. The apparatus of claim 9, wherein the opposed second and third planar contact surfaces are positioned proximate to and overlapping a top and a bottom face of the C-shaped frame, respectively, when the tool holder, interlay, and frame are releasably fastened together.

11. The apparatus of claim 1, wherein:

the ram tool and the countertool are oriented coaxially to each other;

the tool holder at the contact surface is detachably fastened at the planer end face of the C-shaped frame;

the end face partially defines a first recess, the contact surface partially defines a second recess, and the interlay partially defines a third recess; and a fitting key is located in one of the first and third recesses or the second and third recesses.

12. The apparatus of claim 11, wherein the fitting key includes a stepped shape, and the recesses of the end face and the contact surface are offset from each other.

* * * * *